US011594174B2

(12) United States Patent
Park et al.

(10) Patent No.: US 11,594,174 B2
(45) Date of Patent: Feb. 28, 2023

(54) STAGE AND DISPLAY DEVICE INCLUDING THE SAME

(71) Applicant: Samsung Display Co., Ltd., Yongin-si (KR)

(72) Inventors: Jong Won Park, Yongin-si (KR); Min Woo Byun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/682,963

(22) Filed: Feb. 28, 2022

(65) Prior Publication Data

US 2022/0277688 A1 Sep. 1, 2022

Related U.S. Application Data

(63) Continuation of application No. 17/351,745, filed on Jun. 18, 2021, now Pat. No. 11,263,962.

(30) Foreign Application Priority Data

Jun. 29, 2020 (KR) ..... 10-2020-0079406

(51) Int. Cl.
*G09G 3/32* (2016.01)

(52) U.S. Cl.
CPC ..... *G09G 3/32* (2013.01); *G09G 2310/0267* (2013.01); *G09G 2310/0275* (2013.01); *G09G 2310/08* (2013.01); *G09G 2330/028* (2013.01)

(58) Field of Classification Search
CPC ..... G09G 3/32; G09G 2330/028; G09G 2310/0275; G09G 2310/08; G09G 2310/0267
See application file for complete search history.

(56) References Cited

U.S. PATENT DOCUMENTS

| | | | |
|---|---|---|---|
| 9,122,319 | B2 | 9/2015 | Kwak et al. |
| 9,324,270 | B2 | 4/2016 | Jeong |
| 10,636,872 | B1 | 4/2020 | Chang et al. |
| 2019/0097614 | A1 | 3/2019 | Hwang |
| 2019/0304375 | A1 | 10/2019 | Kim et al. |

(Continued)

FOREIGN PATENT DOCUMENTS

| | | |
|---|---|---|
| KR | 10-1881853 | 7/2018 |
| KR | 10-2019-0115144 | 10/2019 |
| KR | 10-2043810 | 11/2019 |

OTHER PUBLICATIONS

Notice of Allowance dated Oct. 13, 2021, in U.S. Appl. No. 17/351,745.

*Primary Examiner* — Andrew Sasinowski
(74) *Attorney, Agent, or Firm* — H.C. Park & Associates, PLC

(57) ABSTRACT

A stage including a node control unit which controls a voltage of a first control node and a voltage of a second control node, in correspondence with a first input signal supplied to a first input terminal, a second input signal supplied to a second input terminal, and a third input signal supplied to a third input terminal, a node maintenance unit which maintains the voltage of the first control node to be constant in correspondence with the voltage of the second control node, and an output unit which supplies a first gate voltage supplied to a first power terminal or a second gate voltage supplied to a second power terminal to an output terminal in correspondence with the voltage of the first control node and the voltage of the second control node.

11 Claims, 8 Drawing Sheets

(56) References Cited

U.S. PATENT DOCUMENTS

| | | | |
|---|---|---|---|
| 2019/0318705 | A1 | 10/2019 | Lee et al. |
| 2020/0074952 | A1 | 3/2020 | Tominaga |
| 2020/0111403 | A1 | 4/2020 | Kim et al. |
| 2020/0118494 | A1 | 4/2020 | Park et al. |
| 2020/0258938 | A1 | 8/2020 | Chai et al. |
| 2021/0202676 | A1 | 7/2021 | Jeong et al. |

STAGE AND DISPLAY DEVICE INCLUDING THE SAME

CROSS-REFERENCE TO RELATED APPLICATION

This application is a Continuation of U.S. patent application Ser. No. 17/351,745, filed Jun. 18, 2021, which claims priority from and the benefit of Korean Patent Application No. 10-2020-0079406, filed on Jun. 29, 2020, which are hereby incorporated by reference for all purposes as if fully set forth herein.

BACKGROUND

Field

Exemplary embodiments of the present invention relate generally to a stage and a display device having the stage, and more particularly, to a stage for supplying a light emission control signal to pixels and a display device having the stage.

Discussion of the Background

A display device displays an image using pixels disposed in a display unit. The pixels are connected to scan lines and data lines, and are driven by a scan signal and a data signal supplied from the scan lines and the data lines.

The pixels may be further connected to light emission control lines, and a light emission period of the pixels may be controlled using a light emission control signal supplied to the light emission control lines. In this case, the display device includes a light emission control driver for generating the light emission control signal.

The light emission control driver includes stages for supplying respective light emission control signals to the light emission control lines. The stages output a second gate voltage to the light emission control line connected to corresponding pixels during the light emission period of the pixels positioned on each horizontal line, and output the light emission control signal of a first gate voltage to the light emission control line in other periods to block light emission.

The display device may have a sequence in which power is turned on again after forcibly resetting a device when the device is required to be protected, such as a case where an unexpected impact is applied from the outside.

When a display device is forcibly reset, a light emission control signal that is outputting a second gate voltage (gate-on voltage) may be instantaneously changed to a ground voltage. When the device is powered on before a sufficient time elapses after the forcible reset, in a lower stage among a plurality of stages of a light emission driver, a first gate voltage (gate-high voltage) is relatively slowly applied to a low buffer gate of an output unit in comparison with an upper stage. Therefore, a short-circuit may occur between the second gate voltage and the first gate voltage.

When a short-circuit occurs between the first gate voltage and the second gate voltage, in a pixel circuit, a short-circuit may occur between first pixel power (VDD) and a data voltage (Vdata) (that is, a data signal). Therefore, an initial abnormal light emission phenomenon (flashing phenomenon) such as a screen flickering may occur.

The above information disclosed in this Background section is only for understanding of the background of the inventive concepts, and, therefore, it may contain information that does not constitute prior art.

SUMMARY

Exemplary embodiments of the present invention provide a stage outputting a normal light emission control signal in a process of power-on after a forcible reset.

Exemplary embodiments of the present invention also provide a display device outputting a normal light emission control signal in a process of power-on after a forcible reset.

Additional features of the inventive concepts will be set forth in the description which follows, and in part will be apparent from the description, or may be learned by practice of the inventive concepts.

An exemplary embodiment of the present invention provides a stage including a node control unit which controls a voltage of a first control node and a voltage of a second control node, in correspondence with a first input signal supplied to a first input terminal, a second input signal supplied to a second input terminal, and a third input signal supplied to a third input terminal, a node maintenance unit which maintains the voltage of the first control node to be constant in correspondence with the voltage of the second control node, and an output unit which supplies a first gate voltage supplied to a first power terminal or a second gate voltage supplied to a second power terminal to an output terminal in correspondence with the voltage of the first control node and the voltage of the second control node.

The node control unit includes a first transistor connected between the first input terminal and the second control node and including a first electrode connected to the first input terminal, a second transistor connected between the first power terminal and the third input terminal and including a first electrode connected to the first power terminal, and a short-circuit prevention transistor connected between the first transistor and the second transistor and including a first electrode connected to a second electrode of the second transistor and a second electrode connected to a second electrode of the first transistor.

A gate electrode of the short-circuit prevention transistor may be connected to the third input terminal, and the short-circuit prevention transistor may be turned on in correspondence with the third input signal.

A gate electrode of the first transistor may be connected to the second input terminal, and the first transistor may be turned on in correspondence with the second input signal.

The node control unit may include a third transistor including a first electrode connected to the second electrode of the second transistor, a second electrode connected to the third input terminal, and a gate electrode connected to the second control node, a fourth transistor including a first electrode connected to a gate electrode of the second transistor, a second electrode connected to the second input terminal, and a gate electrode connected to the second electrode of the first transistor, a fifth transistor including a first electrode connected to the first electrode of the fourth transistor, a second electrode connected to the second power terminal, and a gate electrode connected to the second input terminal, a first coupling transistor including a first electrode connected to the first electrode of the fifth transistor, a second electrode, and a gate electrode connected to the second power terminal, a first coupling capacitor including a first electrode connected to the second electrode of the first coupling transistor, and a second electrode, a sixth transistor including a first electrode connected to the first control node, a second electrode connected to the second electrode of the first coupling capacitor, and a gate electrode connected to the third input terminal, and a seventh transistor including a first electrode connected to the second electrode of the first coupling capacitor, a second electrode connected to the third input terminal, and a gate electrode connected to the first electrode of the first coupling capacitor.

The node control unit may further include a second coupling capacitor including a first electrode connected to the second electrode of the second transistor and a second electrode connected to the gate electrode of the third transistor, and a second coupling transistor connected between the second electrode of the first transistor and the second control node and turned on in correspondence with the second gate voltage.

The node maintenance unit may include an eighth transistor including a first electrode connected to the first power terminal, a second electrode connected to the first control node, and a gate electrode connected to the second electrode of the first transistor, and a first capacitor including a first electrode connected to the first power terminal and a second electrode connected to the first control node.

The output unit may include a pull-up transistor including a first electrode connected to the first power terminal, a second electrode connected to the output terminal, and a gate electrode connected to the first control node, and a pull-down transistor including a first electrode connected to the output terminal, a second electrode connected to the second power terminal, and a gate electrode connected to the second control node.

The first gate voltage may be set to a gate-off voltage, and the second gate voltage may be set to a gate-on voltage.

The first input signal may be a start pulse or an output signal of a previous stage, and the second input signal and the third input signal may be a first clock signal and a second clock signal, respectively.

The first clock signal and the second clock signal may alternately have a gate-on voltage, and the start pulse or the output signal of the previous stage may be supplied to overlap at least one gate-on voltage section of the first clock signal.

Another exemplary embodiment of the present invention provides a display device including pixels connected to scan lines, data lines, and light emission control lines, a scan driver which supplies a scan signal to the scan lines, a data driver which supplies a data signal to the data lines, and a light emission control driver including a plurality of stages to supply a light emission control signal to the light emission control lines.

Each of the stages includes a node control unit which controls a voltage of a first control node and a voltage of a second control node, in correspondence with a first input signal supplied to a first input terminal, a second input signal supplied to a second input terminal, and a third input signal supplied to a third input terminal, and including a first transistor connected between the first input terminal and the second control node and including a first electrode connected to the first input terminal, a second transistor connected between a first power terminal and the third input terminal and including a first electrode connected to the first power terminal, and a short-circuit prevention transistor connected between the first transistor and the second transistor and including a first electrode connected to a second electrode of the second transistor and a second electrode connected to a second electrode of the first transistor, a node maintenance unit which maintains the voltage of the first control node to be constant in correspondence with the voltage of the second control node, and an output unit which supplies a first gate voltage supplied to the first power terminal or a second gate voltage supplied to a second power terminal to an output terminal in correspondence with the voltage of the first control node and the voltage of the second control node.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
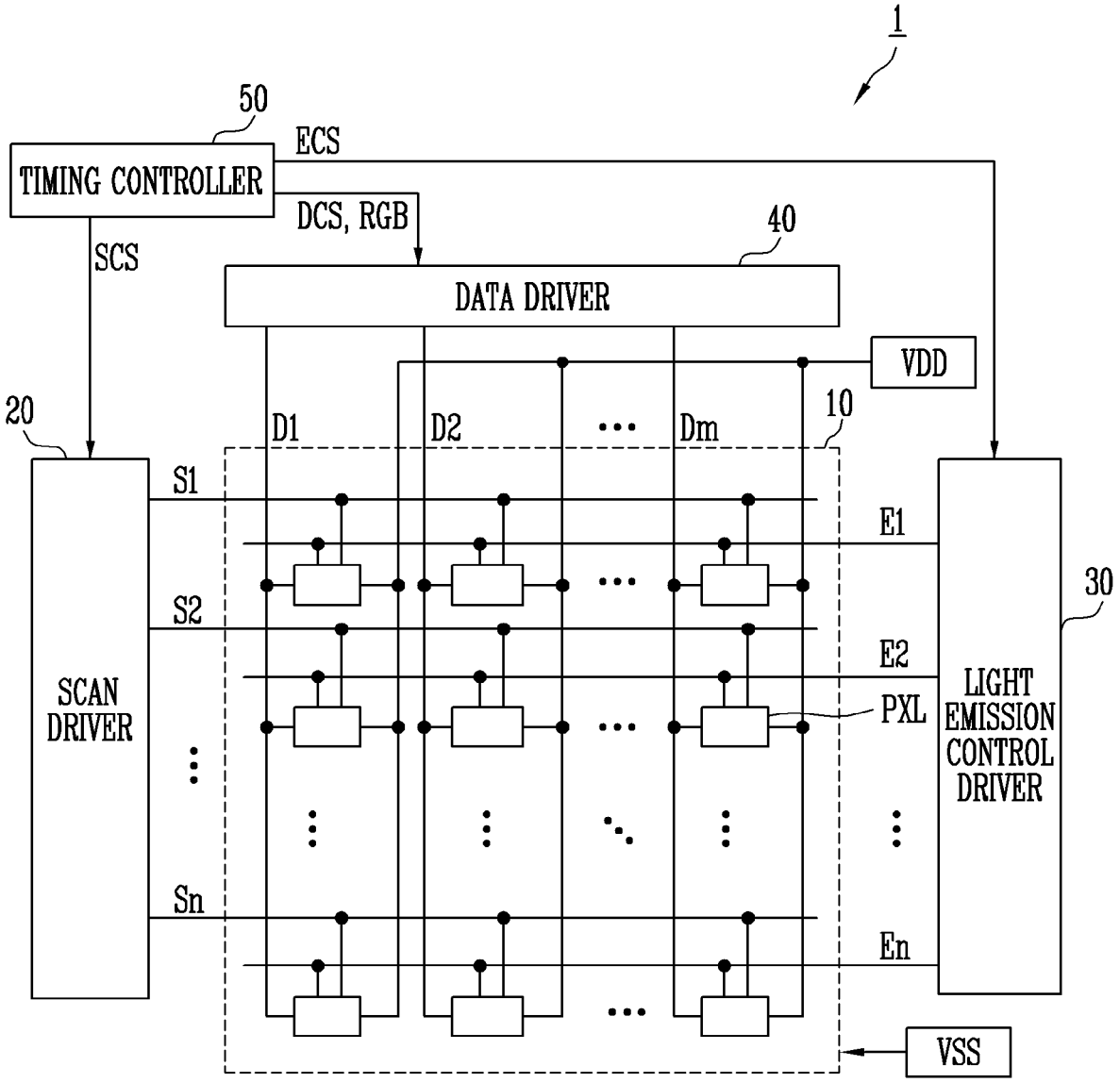
FIG. 1 illustrates a display device according to an exemplary embodiment of the present invention.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 illustrates a display device according to an exemplary embodiment of the present invention. FIG. 1 shows a light emitting display device including light emitting elements as an example of the display device 1, but the display device 1 according to the inventive concepts is not limited thereto.

Referring to FIG. 1, the display device 1 according to an exemplary embodiment of the present invention may include a display unit 10, a scan driver 20 for driving the display unit 10, a light emission control driver 30, a data driver 40, and a timing controller 50.

The display unit 10 may include scan lines S1 to Sn, light emission control lines E1 to En, and pixels PXL connected to data lines D1 to Dm. In describing an exemplary embodiment of the present invention, a "connection" may comprehensively mean an electrical connection and/or a physical connection. For example, the pixels PXL may be electrically connected to the scan lines S1 to Sn, the light emission control lines E1 to En, and the data lines D1 to Dm.

The pixels PXL may receive scan signals, light emission control signals, and data signals from the scan lines S1 to Sn, the light emission control lines E1 to En, and the data lines D1 to Dm, respectively. In addition, the pixels PXL may further receive driving power such as first pixel power VDD and second pixel power VSS.

The pixels PXL may receive respective data signals from the data lines D1 to Dm when respective scan signals are supplied from the scan lines S1 to Sn, and emit light with a luminance corresponding to the data signal. Accordingly, an image corresponding to the data signal of each frame may be displayed on the display unit 10.

Each pixel PXL may include a light emitting element and a pixel circuit for driving the light emitting element. The pixel circuit controls a driving current flowing from the first pixel power VDD to the second pixel power VSS via the light emitting element in correspondence with the data signal.

The scan driver 20 may receive a scan driving control signal SCS from the timing controller 50 and supply the scan signal to the scan lines S1 to Sn in correspondence with the scan driving control signal SCS. For example, the scan driver 20 may sequentially supply the scan signal to the scan lines S1 to Sn. When the scan signal is sequentially supplied to the scan lines S1 to Sn, the pixels PXL are selected in a horizontal line unit in correspondence with each scan signal.

The scan signal may be used to select the pixels PXL in the horizontal line unit. For example, the scan signal may have a second gate voltage (for example, a logic low level) at which a transistor of each pixel PXL connected to the data lines D1 to Dm may be turned on, and may be supplied to the pixels disposed on a corresponding horizontal line each horizontal period.

The pixels PXL receiving the scan signal may be connected to the data lines D1 to Dm during a period in which the scan signal is supplied, and thus receive each data signal. That is, the scan signal may be supplied to transfer the data signal to the pixels PXL.

The light emission control driver 30 may receive a light emission driving control signal ECS from the timing controller 50 and supply a light emission control signal to the light emission control lines E1 to En in correspondence with the light emission driving control signal ECS. For example, the light emission control driver 30 may sequentially supply the light emission control signal to the light emission control lines E1 to En.

The light emission control signal may be used to control a light emission period (for example, a light emission time point and/or a light emission duration) of the pixels PXL in the horizontal line unit. For example, the light emission control signal may have a first gate voltage (gate-off voltage, for example, a logic high level) at which at least one transistor disposed on a current path of each of the pixels PXL may be turned off. In this case, the pixel PXL receiving the light emission control signal may be set to a non-light emission state during a period in which the light emission control signal is supplied, and may be set to a light emission state during other periods. Meanwhile, when a data signal corresponding to a black grayscale is supplied to a specific pixel PXL, the pixel PXL may maintain the non-light emission state in correspondence with the data signal even though the light emission control signal is not supplied.

The data driver 40 may receive a data driving control signal DCS and image data RGB from the timing controller 50, and supply the data signal to the data lines D1 to Dm in correspondence with the data driving control signal DCS and the image data RGB. The data signal supplied to the data lines D1 to Dm is supplied to the pixels PXL selected by the scan signal. To this end, the data driver 40 may supply the data signal to the data lines D1 to Dm in synchronization with each scan signal. For example, the data driver 40 may output the data signal corresponding to the pixels PXL of the corresponding horizontal line to the data lines D1 to Dm in synchronization with the scan signal for each horizontal period.

The timing controller 50 receives various control signals (for example, vertical/horizontal synchronization signals, a main clock signal, and the like) from the outside (for example, a host processor), and generates the scan driving control signals SCS, the light emission driving control signal ECS, and the data driving control signal DCS in correspondence with the control signals. The scan driving control signal SCS, the light emission driving control signal ECS, and the data driving control signal DCS may be supplied to the scan driver 20, the light emission control driver 30, and the data driver 40, respectively.

The scan driving control signal SCS may include a start pulse and clock signals. The start pulse controls an output timing of a first scan signal (for example, a scan signal supplied to the first scan line S1), and the clock signals are used to shift the start pulse.

The light emission driving control signal ECS includes a start pulse and clock signals. The start pulse controls an output timing of a first light emission control signal (for example, a light emission control signal supplied to the first light emission control line E1), and the clock signals are used to shift the start pulse.

The data driving control signal DCS includes a source start pulse and clock signals. The source start pulse controls a sampling start time point of data, and the clock signals are used to control a sampling operation.

In addition, the timing controller 50 receives input image data from the outside, rearranges the input image data, and generates the image data RGB. The timing controller 50 may supply the image data RGB to the data driver 40.

Figure 2A:
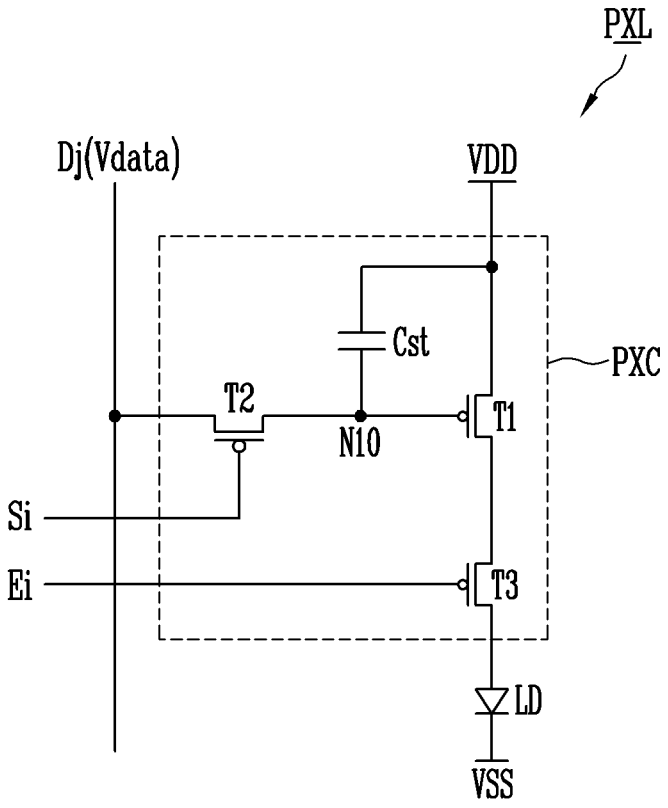
FIGS. 2A and 2B illustrate pixels according to exemplary embodiment of the present invention, respectively.
Figure 2B:
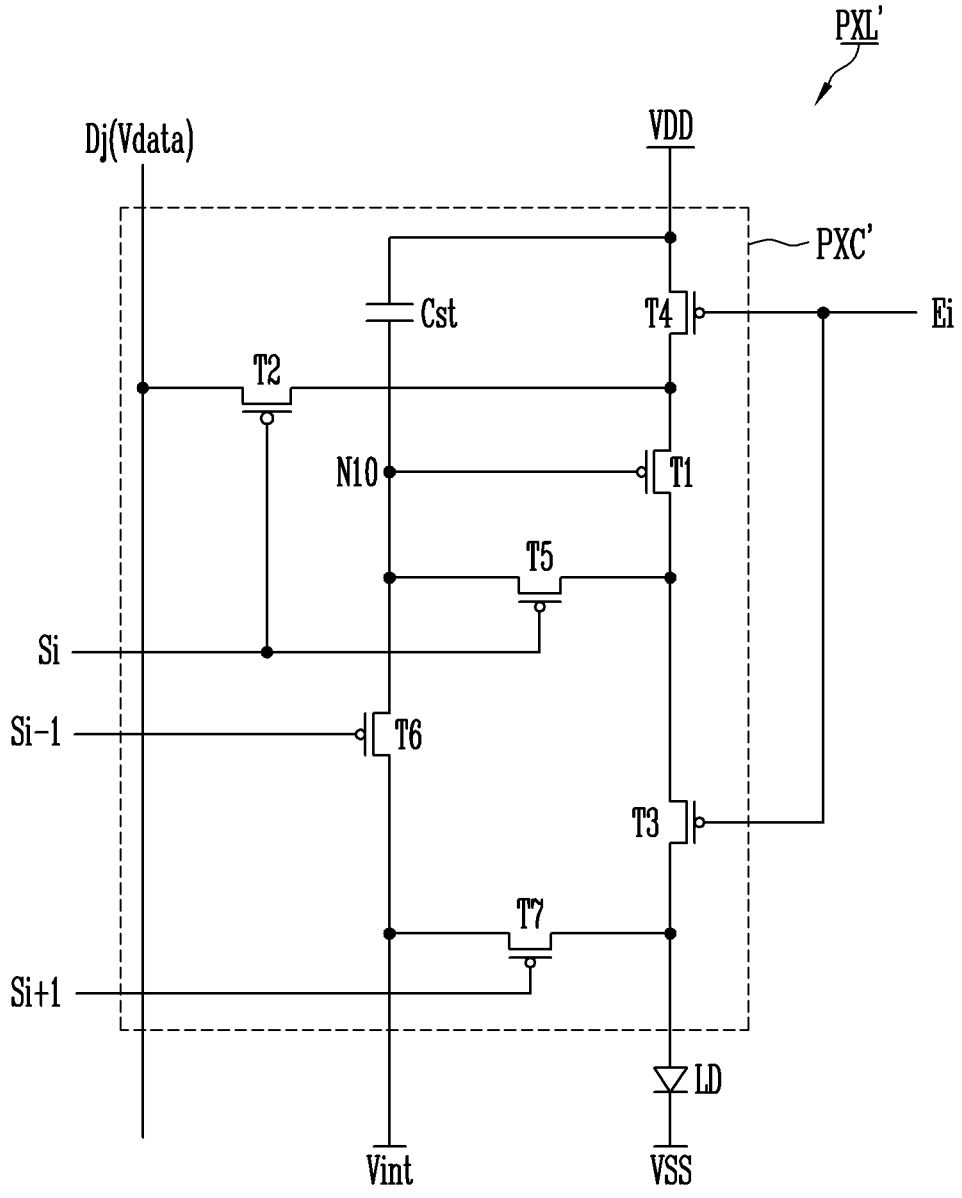

FIGS. 2A and 2B illustrate pixels according to an exemplary embodiment of the present invention, respectively. For example, FIGS. 2A and 2B illustrate different embodiments of the pixels PXL that may be disposed on the display unit 10 of FIG. 1. The pixels PXL and PXL' may be disposed on an i-th (i is a natural number) horizontal line and a j-th (j is a natural number) vertical line of the display unit 10, and may be connected to an i-th scan line S1, an i-th light emission control line Ei, and a j-th data line Dj. According to an exemplary embodiment, the pixels PXL disposed on the display unit 10 of FIG. 1 may have substantially the same structure. Hereinafter, the "i-th scan line S1", the "i-th light emission control line Ei", and the "j-th data line Dj" are referred to as a "scan line S1", a "light emission control line Ei", and a "data line Dj", respectively.

Referring to FIG. 2A, the pixel PXL according to an exemplary embodiment of the present invention includes a light emitting element LD and a pixel circuit PXC for driving the light emitting element LD. According to an exemplary embodiment, the light emitting element LD may be connected between the pixel circuit PXC and the second pixel power VSS, but a position of the light emitting element LD is not limited thereto. For example, in another embodiment, the light emitting element LD may be connected between the first pixel power VDD and the pixel circuit PXC.

The light emitting element LD is connected between the first pixel power VDD and the second pixel power VSS in a forward direction. For example, an anode electrode of the light emitting element LD may be connected to the first pixel power VDD via the pixel circuit PXC, and a cathode electrode of the light emitting element LD may be connected to the second pixel power VSS. The first pixel power VDD and the second pixel power VSS may have a potential difference that allows the light emitting element LD to emit light. For example, the first pixel power VDD may be a high potential pixel power, and the second pixel power VSS may have a low potential pixel power having a potential lower than that of the first pixel power VDD by a threshold voltage or more of the light emitting element LD.

The light emitting element LD may be configured of an organic light emitting diode. In addition, the light emitting element LD may be configured of a micro light emitting diode (LED), or an inorganic LED, such as a quantum dot LED. In addition, the light emitting element LD may be configured of an organic material and an inorganic material in a complex manner. In FIGS. 2A and 2B, the pixels PXL and PXL' include a single light emitting element LD, but in another embodiment, the pixels PXL and PXL' may include a plurality of light emitting elements EL, and the plurality of light emitting elements LD may be connected to each other in series, in parallel, or in series and parallel. The pixel circuit PXC includes a first transistor T1 (a driving transistor), a second transistor T2, a third transistor T3, and a storage capacitor Cst.

The first transistor T1 is connected between the first pixel power VDD and the light emitting element LD. For example, a first electrode (for example, a source electrode) of the first transistor T1 may be connected to the first pixel power VDD, and a second electrode (for example, a drain electrode) of the first transistor T1 may be connected to the anode electrode of the light emitting element LD via the third transistor T3. In addition, a gate electrode of the first transistor T1 is connected to a tenth node N10. The first transistor T1 controls a driving current flowing from the first pixel power VDD to the second pixel power VSS via the third transistor T3 and the light emitting element LD in correspondence with a voltage of the tenth node N10.

The second transistor T2 is connected between the data line Dj and the tenth node N10. For example, a first electrode (for example, a source electrode) of the second transistor T2 may be connected to the data line Dj, and a second electrode (for example, a drain electrode) of the second transistor T2 may be connected to the tenth node N10. In addition, a gate electrode of the second transistor T2 is connected to the scan line S1. The second transistor T2 is turned on when the scan signal (for example, a scan signal of a logic low level) is supplied to the scan line S1 to transfer the data signal from the data line Dj to the tenth node N10.

The third transistor T3 is connected between the first transistor T1 and the light emitting element LD. For example, a first electrode (for example, a source electrode) of the third transistor T3 may be connected to the second electrode of the first transistor T1, and a second electrode (for example, a drain electrode) of the third transistor T3 may be connected to the anode electrode of the light emitting element LD. In addition, a gate electrode of the third transistor T3 is connected to the light emission control line Ei. The third transistor T3 is turned off when the light emission control signal (for example, a light emission control signal of a logic high level) is supplied to the light emission control line Ei, and turned on in other cases (for example, when the supply of the light emission control signal is stopped and a voltage of the light emission control line Ei is maintained at the second gate voltage).

When the third transistor T3 is turned off, a connection between the first transistor T1 and the light emitting element LD is cut off. Therefore, a current path is blocked inside the pixel PXL, and thus the pixel PXL does not emit light. When the third transistor T3 is turned on, the first transistor T1 and the light emitting element LD are electrically connected to each other. Therefore, a current path through which the driving current may flow is formed in the pixel PXL, and thus the pixel PXL may emit light.

The storage capacitor Cst is connected between the first pixel power VDD and the tenth node N10. The storage capacitor Cst charges a voltage corresponding to the voltage of the tenth node N10.

Meanwhile, a structure of the pixel PXL may be variously changed according to the inventive concepts. For example, a structure of the pixel circuit PXC may be changed as in the embodiment shown in FIG. 2B.

Referring to FIG. 2B, the pixel PXL' includes a light emitting element LD and a pixel circuit PXC' for driving the light emitting element LD. The pixel circuit PXC' includes first to seventh transistors T1 to T7 and a storage capacitor Cst.

An anode electrode of the light emitting element LD is connected to the first transistor T1 via the third transistor T3, and a cathode electrode of the light emitting element LD connected to the second pixel power VSS. When a driving current is supplied from the first transistor T1, the light emitting element LD generates light of a luminance corresponding to a current amount of the driving current.

A first electrode of the first transistor T1 is connected to the first pixel power VDD via the fourth transistor T4, and a second electrode of the first transistor T1 is connected to the anode electrode of the light emitting element LD via the third transistor T3. In addition, a gate electrode of the first transistor T1 may be connected to a tenth node N10. The first transistor T1 controls a driving current flowing from the first pixel power VDD to the second pixel power VSS via the light emitting element LD in correspondence with a voltage of the tenth node N10.

The second transistor T2 is connected between the data line Dj and the first electrode of the first transistor T1. In addition, a gate electrode of the second transistor T2 is connected to the scan line S1. The second transistor T2 is turned on when the scan signal is supplied to the scan line S1, to connect the data line Dj and the first electrode of the first transistor T1. Therefore, when the second transistor T2 is turned on, the data signal from the data line Dj may be transferred to the first electrode of the first transistor T1. Meanwhile, during a period in which the second transistor T2 is turned on by the scan signal, the first transistor T1 is turned on in a diode-connected form by the fifth transistor T5. Accordingly, the data signal from the data line Dj may be transferred to the tenth node N10 via the second transistor T2, the first transistor T1, and the fifth transistor T5. Then, the storage capacitor Cst charges a voltage corresponding to the data signal and a threshold voltage of the first transistor T1.

The third transistor T3 is connected between the first transistor T1 and the light emitting element LD, and a gate electrode of the third transistor T3 is connected to the light emission control line Ei. The third transistor T3 is turned off when the light emission control signal is supplied to the light emission control line Ei, and is turned on in other cases.

The fourth transistor T4 is connected between the first pixel power VDD and the first transistor T1. In addition, a gate electrode of the fourth transistor T4 is connected to the light emission control line Ei. The fourth transistor T4 is turned off when the light emission control signal is supplied to the light emission control line Ei, and is turned on in other cases.

That is, the third and fourth transistors T3 and T4 may be simultaneously turned on or turned off by the light emission control signal. When the third and fourth transistors T3 and T4 are turned on, a current path through which a driving current flows is formed in the pixel PXL. Conversely, when the third and fourth transistors T3 and T4 are turned off, the current path is blocked, and thus the pixel PXL does not emit light.

The fifth transistor T5 is connected between the first transistor T1 and the tenth node N10. In addition, a gate electrode of the fifth transistor T5 is connected to the scan line S1. The fifth transistor T5 is turned on when the scan signal is supplied to the scan line S1, to connect the second electrode of the first transistor T1 and the tenth node N10. Therefore, when the fifth transistor T5 is turned on, the first transistor T1 is connected in a form of a diode.

The sixth transistor T6 is connected between the tenth node N10 and initialization power Vint. In addition, a gate electrode of the sixth transistor T6 is connected to a previous scan line, for example, an (i−1)-th scan line Si-1. The sixth transistor T6 is turned on when the scan signal is supplied to the (i−1)-th scan line Si-1, to initialize the voltage of the tenth node N10 to a voltage of the initialization power Vint.

Meanwhile, in the present embodiment, the (i−1)-th scan line Si-1 is used as an initialization control line for initializing the gate of the first transistor T1, that is, the tenth node N10, but the inventive concepts are not limited thereto. For example, in another embodiment, another control line including an (i-2)-th scan line Si-2 may be used as the initialization control line for initializing the gate node of the first transistor T1.

The voltage of the initialization power Vint may be set to a voltage lower than a voltage of the data signal. That is, the voltage of the initialization power Vint may be set to be equal to or less than a minimum voltage of the data signal. Therefore, before transmitting the data signal of a current frame to each pixel PXL, when the voltage of the tenth node N10 charged by the data signal of a previous frame is initialized to be equal to or less than the minimum voltage of the data signal, the first transistor T1 is diode-connected in a forward direction while the scan signal is supplied to the scan line S1 regardless of the data signal of the previous frame. Accordingly, the data signal of the current frame may be stably transferred to the tenth node N10.

The seventh transistor T7 is connected between the initialization power Vint and the anode electrode of the light emitting element LD. In addition, a gate electrode of the seventh transistor T7 is connected to an (i+1)-th scan line S1+1. The seventh transistor T7 is turned on when the scan signal is supplied to the (i+1)-th scan line S1+1, to initialize an anode voltage of the light emitting element LD to the voltage of the initialization power Vint. Accordingly, the pixel PXL may exhibit a uniform luminance characteristic.

Meanwhile, in the present embodiment, a case where an anode initialization control line to which the gate electrode of the seventh transistor T7 is connected is the (i+1)-th scan line (S1+1) is described as an example, but the inventive concepts are not limited thereto. For example, in another embodiment, the gate electrode of the seventh transistor T7 may be connected to a current scan line, that is, the scan line S1 (or another control line). In this case, when the scan signal is supplied to the scan line S1, the anode voltage of the light emitting element LD may be initialized to the voltage of the initialization power Vint.

The storage capacitor Cst is connected between the first pixel power VDD and the tenth node N10. The storage capacitor Cst charges a voltage corresponding to the data signal and a voltage corresponding to a threshold voltage of the first transistor T1.

Meanwhile, structures of the pixels PXL and PXL' are not limited to the embodiments shown in FIGS. 2A and 2B. For example, the pixel circuits PXC and PXC' may have various structures which are currently known.

Figure 3:
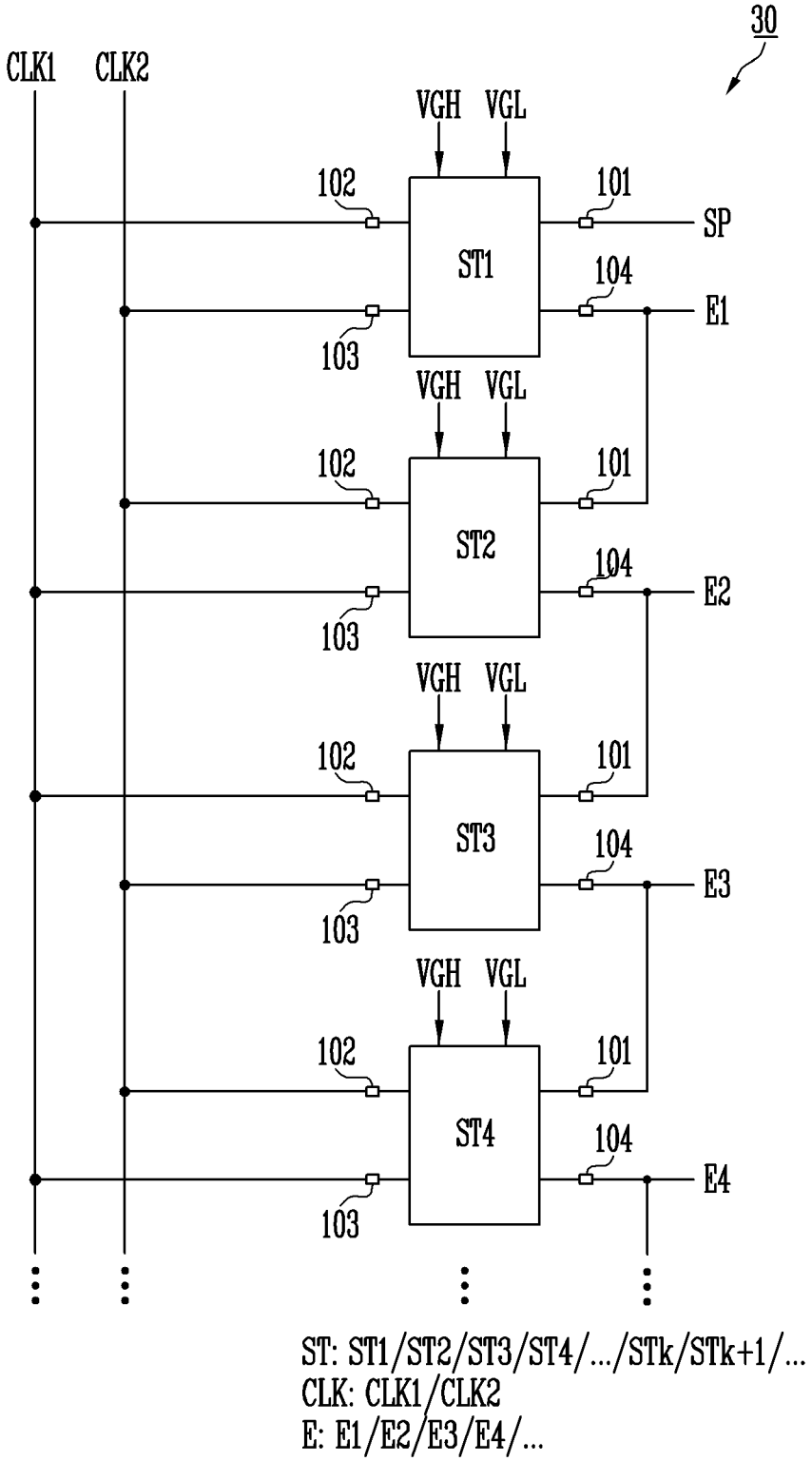
FIG. 3 illustrates a light emission control driver according to exemplary embodiment of the present invention.

FIG. 3 illustrates a light emission control driver according to an exemplary embodiment of the present invention. For convenience, in FIG. 3, only four stages ST, for example, first to fourth stages ST1 to ST4 are shown. According to an embodiment, the light emission control driver 30 may include a plurality of stages ST dependently connected to an input terminal (for example, a first input terminal 101 of the first stage ST1) of a start pulse SP, such as the first to fourth stages ST1 to ST4.

Referring to FIG. 3, the light emission control driver 30 according to an exemplary embodiment of the present invention may include the plurality of stages ST to supply respective light emission control signals to the plurality of light emission control lines E. The stages ST may be connected to any one of the light emission control lines E1 to E4, and may be driven in correspondence with at least one clock signal CLK (for example, first and second clock signals CLK1 and CLK2). For example, the first to fourth stages ST1 to ST4 may be connected to the first to fourth light emission control lines E1 to E4, respectively, and may generate respective light emission control signals using the first and second clock signals CLK1 and CLK2. The first to fourth stages ST1 to ST4 may sequentially output the light emission control signal to the first to fourth light emission control lines E1 to E4. According to an exemplary embodiment, the stages ST may have substantially the same circuit structure.

Each of the stages ST may include the first input terminal 101, a second input terminal 102, a third input terminal 103, and an output terminal 104.

The first input terminal 101 may receive a first input signal. According to an exemplary embodiment, the first input signal may be the start pulse SP or an output signal of a previous stage (that is, a light emission control signal of the previous stage). For example, the first stage (hereinafter referred to as the "first stage ST1") may receive the start pulse SP through the first input terminal 101, and the remaining stages ST may receive an output signal of the previous stage through the respective input terminals 101.

The second input terminal 102 and the third input terminal 103 may receive a second input signal and a third input signal, respectively. According to an exemplary embodiment, the second input signal and the third input signal of a k-th (k is odd or even) stage STk may be the first clock signal CLK1 and the second clock signal CLK2, respectively. In addition, the second input signal and the third input signal of a (k+1)-th stage STk+1 may be the second clock signal CLK2 and the first clock signal CLK1, respectively. For example, the k-th stage STk may receive the first clock signal CLK1 and the second clock signal CLK2 through the second input terminal 102 and the third input terminal 103, respectively, and the (k+1)-th stage STk+1 may receive the second clock signal CLK2 and the first clock signal CLK1 through the second input terminal 102 and the third input terminal 103, respectively.

The first clock signal CLK1 and the second clock signal CLK2 may alternately have the second gate voltage. For example, the first clock signal CLK1 and the second clock signal CLK2 may be signals having the same period and phases which are not overlapping each other. For example, the second clock signal CLK2 may be a clock signal of a form in which the first clock signal CLK1 is shifted by half a period.

Additionally, the stages ST may operate by receiving the first gate voltage VGH and the second gate voltage VGL. The first gate voltage VGH may be set to a gate-off voltage, for example, a logic high level, and the second gate voltage VGL may be set to a gate-on voltage, for example, a logic low level (when the pixels are formed of a P-type transistor). In this case, the first gate voltage VGH transferred to the output terminal 104 may be used as the light emission control signal preventing light emission of the pixels PXL.

Figure 4:
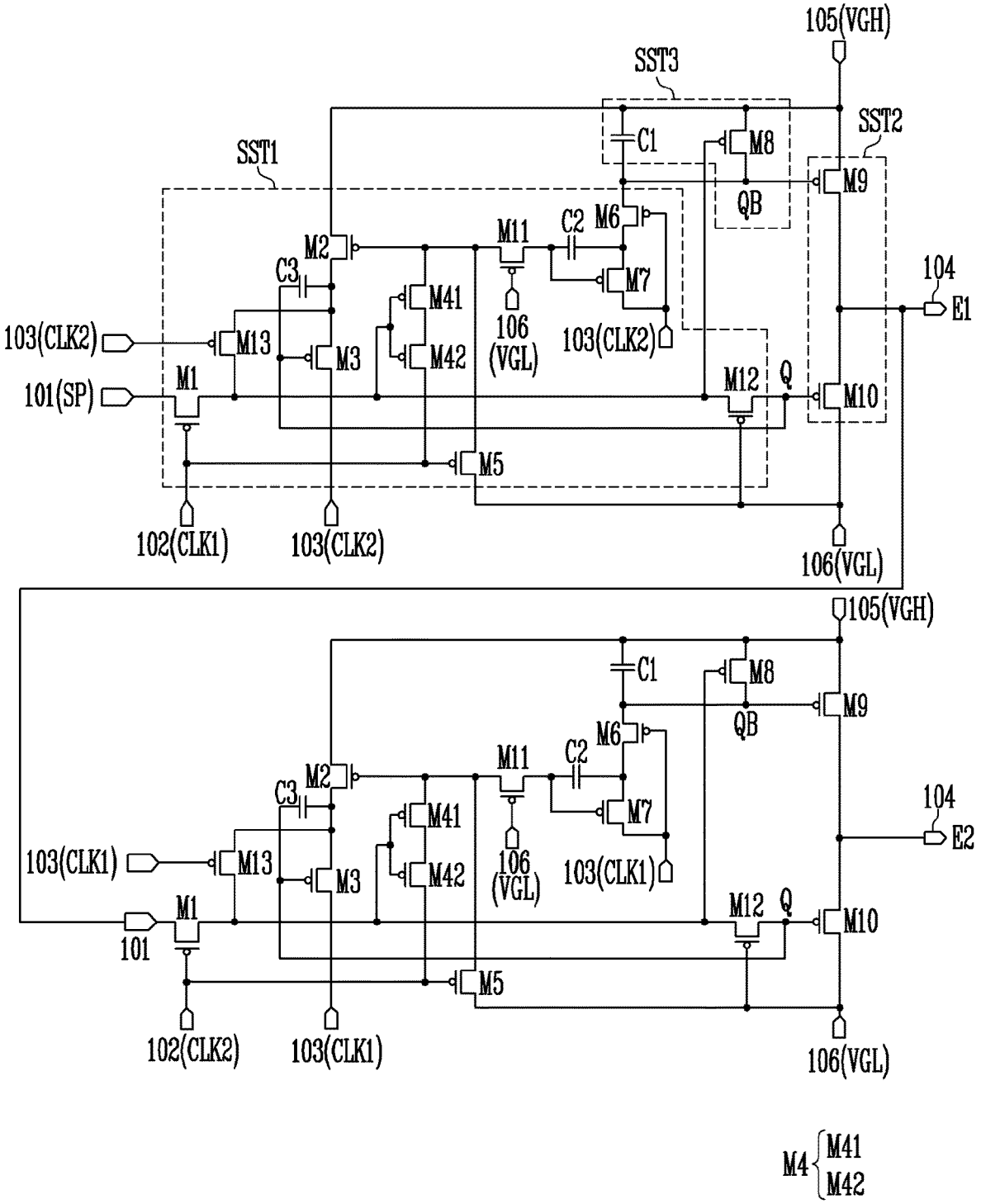
FIG. 4 illustrates an exemplary embodiment of a stage shown in FIG. 3.

FIG. 4 illustrates an embodiment of the stage shown in FIG. 3. According to an embodiment, the plurality of stages ST configuring the light emission control driver 30 may have substantially the same circuit structure. Therefore, in FIG. 4, only the first stage ST1 and the second stage ST2 are shown on behalf of the stages ST.

Referring to FIGS. 3 and 4, the stage ST may include a node control unit SST1, an output unit SST2 (or a buffer unit), and a node maintenance unit SST3.

The stage ST may generate the light emission control signal using the first to third input signals supplied through the first to third input terminals 101 to 103, respectively, and supply the generated light emission control signal to the output terminal 104. For example, the stage ST may output light emission control signals using a start pulse or a previous stage output signal and first and second clock signals CLK1 and CLK2 supplied through the first to third input terminals 101 to 103, respectively.

In addition, the stage ST may receive the first and second gate voltages VGH and VGL through first and second power terminals 105 and 106, respectively. The stage ST may control a voltage of the output terminal 104 using voltages of the first and second gate voltages VGH and VGL supplied to the first and second power terminals 105 and 106. For convenience, a circuit structure of each stage ST is described below based on the first stage ST1.

First, the output unit SST2 may be connected to the first power terminal 105 and the second power terminal 106, and the output unit SST2 may output the first gate voltage VGH to the output terminal 104 as the light emission control signal based on a voltage of a second control node Q and a voltage of the first control node QB.

The output unit SST2 may include a ninth transistor M9 (or a pull-up transistor) and a tenth transistor M10 (or a pull-down transistor).

The ninth transistor M9 may include a first electrode connected to the first power terminal 105, a second electrode connected to the output terminal 104, and a gate electrode connected to the first control node QB.

The tenth transistor M10 may include a first electrode connected to the output terminal 104, a second electrode connected to the second power terminal 106, and a gate electrode connected to the second control node Q.

The node control unit SST1 may be connected to the first input terminal 101, the second input terminal 102, the third input terminal 103, the first power terminal 105, and the second power terminal 106. The node control unit SST1 may control the voltage of the first control node QB and the voltage of the second control node Q using the start pulse SP (or the light emission control signal of the previous stage) provided through the first input terminal 101.

The node control unit SST1 may include first, second, third, fourth, fifth, sixth, seventh, eleventh, twelfth, and thirteenth transistors M1, M2, M3, M4, M5, M6, M7, M11, M12, and M13, a second capacitor C2 (or a first coupling capacitor), and a third capacitor C3 (or a second coupling capacitor).

The first transistor M1 may include a first electrode connected to the first input terminal 101, a second electrode connected to a first electrode of the twelfth transistor M12, and a gate connected to the second input terminal 102.

The second transistor M2 may include a first electrode connected to the first power terminal 105, a second electrode connected to a first electrode of the third transistor M3, and a gate electrode connected to a first electrode of the eleventh transistor M11.

The third transistor M3 may include the first electrode connected to the second electrode of the second transistor M2, a second electrode connected to the third input terminal 103, and a gate connected to the second control node Q.

The third capacitor C3 may be formed between the second electrode of the second transistor M2 and the second control node Q, and may include a first electrode connected to the second electrode of the second transistor M2 and a second electrode connected to the second control node Q. According to an embodiment, the second electrode of the third capacitor C3 may be connected to the gate electrode of the third transistor M3.

The fourth transistor M4 may include a first electrode connected to the gate electrode of the second transistor M2, a second electrode connected to the second input terminal 102, and a gate electrode connected to the second electrode of the first transistor M1. The fourth transistor M4 may be configured by connecting a plurality of transistors M41 and M42 in series.

The fifth transistor M5 may include a first electrode connected to the gate electrode of the second transistor M2, a second electrode connected to the second power terminal 106, and a gate electrode connected to the second input terminal 102.

The sixth transistor M6 may include a first electrode connected to the first control node QB, a second electrode connected to a first electrode of the seventh transistor M7, and a to gate electrode connected to the third input terminal 103.

The seventh transistor M7 may include a first electrode connected to the second electrode of the sixth transistor M6, a second electrode connected to the third input terminal 103, and a gate electrode connected to a second electrode of the eleventh transistor M11.

The second capacitor C2 (or the first coupling capacitor) may be formed between is the second electrode of the eleventh transistor M11 and the second electrode of the sixth transistor M6, and may include a first electrode connected to the second electrode of the eleventh transistor M11 and a second electrode connected to the second electrode of the sixth transistor M6.

The eleventh transistor M11 (or a first coupling transistor) may include the first electrode connected to the gate electrode of the second transistor M2, the second electrode connected to the first electrode of the second capacitor C2, and a gate electrode connected to the second power terminal 106.

The twelfth transistor M12 (or a second coupling transistor) may include the first electrode connected to the second electrode of the first transistor M1, a second electrode connected to the second control node Q, and a gate electrode connected to the second power terminal 106.

The thirteenth transistor M13 (or a short-circuit protection transistor) may include a first electrode connected to the second electrode of the second transistor M2, a second electrode connected to the second electrode of the first transistor M1, and a gate electrode connected to the third input terminal 103. When the display device 1 is powered on after the forcible reset, the second clock signal CLK2 of a logic low level may be applied to the third input terminal 103, and thus, the thirteenth transistor M13 may be turned on in response to the second clock signal CLK2 of the logic low level. Therefore, a voltage at the second electrode (that is, the second control node Q) of the first transistor T1 immediately may have the first gate voltage VGH, and thus, a turn-off operation of the tenth transistor M10 may be quickly performed.

The node maintenance unit SST3 may maintain the voltage of the first control node QB to be constant in response to the voltage of the second control node Q. The node maintenance unit SST3 may include a first capacitor C1 and an eighth transistor T8.

The first capacitor C1 is formed at the first power terminal 105 and the first control node QB, and may include a first electrode connected to the first power terminal 105 and a second electrode connected to the first control node QB.

The eighth transistor M8 may include a first electrode connected to the first power terminal 105, a second electrode connected to the first control node QB, and a gate connected to the second electrode of the first transistor M1. The eighth transistor M8 may maintain the voltage of the first control node QB to be constant in response to the voltage at the second electrode of the first transistor M1 (that is, the voltage of the second control node Q). For example, when the voltage of the second control node Q has a logic low level, the eighth transistor M8 may maintain the voltage of the first control node QB to a logic high level using the first gate voltage VGH.

Each of the first to thirteenth transistors M1 to M13 may be a P-type transistor. In FIG. 4, the first to third transistors M1 to M3 and the fifth to thirteenth transistors M5 to M13 are single gate transistors, and the fourth transistor M4 is a dual gate transistor (that is, a dual gate transistor configured of two transistors connected to each other in series and having gate electrodes connected to each other), but the inventive concepts are not limited thereto. For example, in order to improve reliability, at least one of the first to third transistors M1 to M3 and the fifth to thirteenth transistors M5 to M13 may be additionally implemented as a dual gate transistor.

The first to third input signals supplied to the first to third input terminals 101 to 103 of the second stage ST2 are different from those of the first stage ST1, and a circuit structure and an operation process of the second stage ST2 may be substantially the same as the first stage ST1. For example, the second stage ST2 may receive an output signal (the first light emission control signal supplied to the first light emission control line E1) of the first stage ST1, the second clock signal CLK2, and the first clock signal CLK1 through the first to third input terminals 101 to 103, respectively, and generate the light emission control signal using the output signal of the first stage ST1, the second clock signal CLK2, and the first clock signal CLK1. The light emission control signal generated by the second stage ST2 is supplied to the second light emission control line E2.

The stages ST may sequentially output the light emission control signal to each light emission control line E in the method described above. A circuit structure and an operation process of each of the second stage ST2 and subsequent stages ST may be substantially the same as the first stage ST1. Therefore, a detailed description thereof is omitted.

FIG. 4 may be referred to in order to describe the operation of the first stage ST1 and the second stage ST2.

Figure 5:
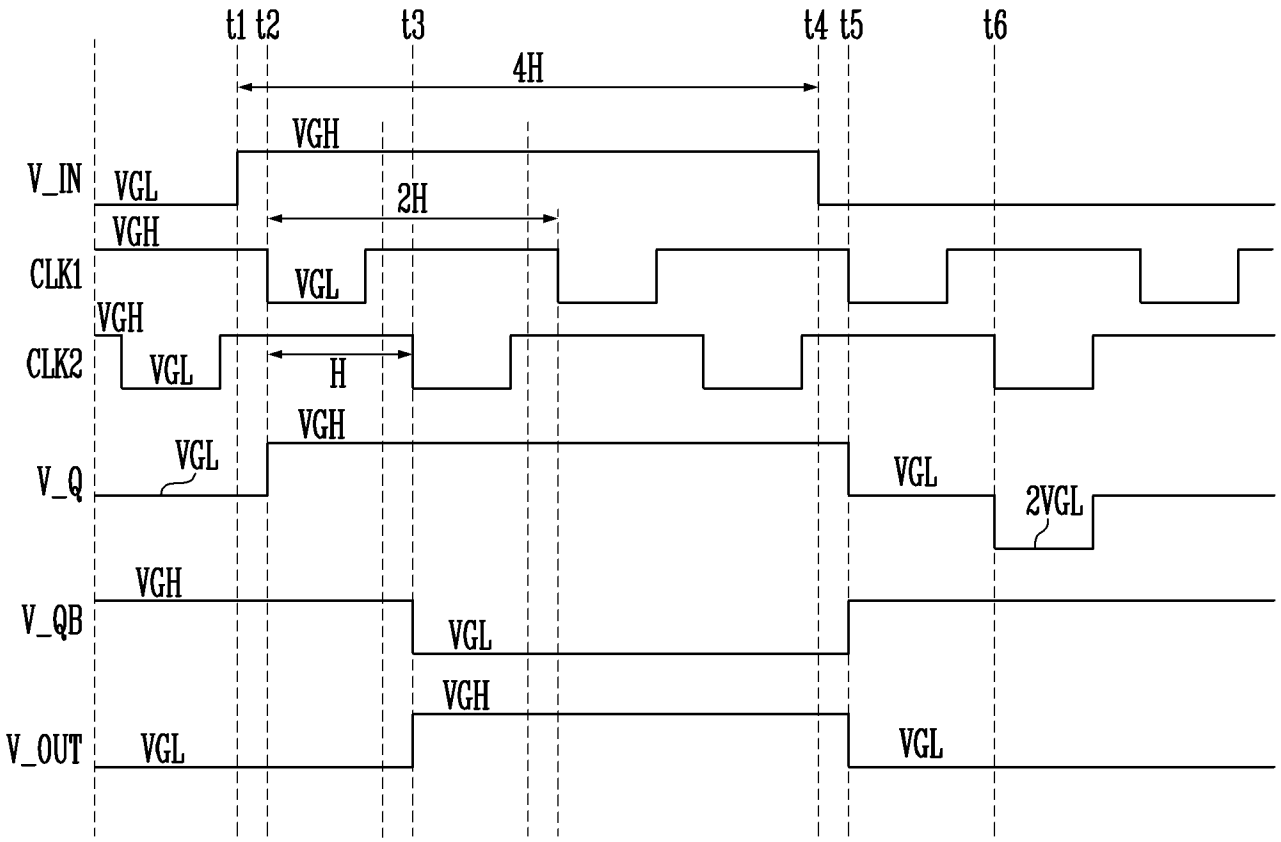
FIG. 5 is a waveform diagram illustrating an example of signals measured in a first stage of FIG. 4.

FIG. 5 is a waveform diagram illustrating an example of signals measured in the first stage of FIG. 4. Since the operations of the first stage ST1 and the second stage ST2 are substantially the same or similar to each other, the operation of the first stage ST1 is described by covering the first stage ST1 and the second stage ST2.

Referring to FIGS. 4 and 5, the first clock signal CLK1 applied to the second input terminal 102 may have a logic low level and a logic high level in a period of 2 horizontal times 2H. Here, the logic low level may be the same as a voltage level of the second gate voltage VGL that turns on the P-type transistor. The logic high level may be the same as a level of the first gate voltage VGH that turns off the P-type transistor.

The second clock signal CLK2 applied to the third input terminal 103 may have a waveform in which the first clock signal CLK1 is delayed by half a period (that is, one horizontal time 1H).

At a first time point t1, an input voltage VIN (for example, the start pulse SP) at the first input terminal 101 may be changed from a logic low level to a logic high level. For example, the input voltage VIN may be maintained to a logic high level for four horizontal times 4H.

At the first time point t1, a second node voltage V_Q at the second control node Q may have a logic low level, the second node voltage V_Q at the first control node QB may have a logic high level, and an output voltage V_OUT (that is, the light emission control signal) at the output terminal 104 may have a logic low level.

At a second time point t2, the first clock signal CLK1 may be changed from a logic high level to a logic low level.

The first transistor M1 may be turned on in response to the first clock signal CLK1 of the logic low level, and the input voltage VIN of the logic high level may be applied to the first electrode of the twelfth transistor M12. Since the twelfth transistor M12 is turned on by the second gate voltage VGL, the input voltage VIN of the logic high level may be applied to the second control node Q through the twelfth transistor M12. That is, the second node voltage V_Q may be changed to have a logic high level.

In addition, the fifth transistor M5 may be turned on in response to the first clock signal CLK1 of the logic low level and the second gate voltage VGL may be applied to the first electrode of the eleventh transistor M11. Since the eleventh transistor M11 is turned on by the second gate voltage VGL, the second gate voltage VGL may be applied to the first electrode of the second capacitor C2. The seventh transistor M7 may be turned on in response to the second gate voltage VGL (that is, the second gate voltage VGL applied to the first electrode of the second capacitor C2), and the second clock signal CLK2 of the logic high level may be applied to the second electrode of the second capacitor C2. Therefore, a voltage corresponding to a difference between the logic high level and the logic low level may be charged in the second capacitor C2.

The second transistor M2 may be turned on in response to the second gate voltage VGL, and the first gate voltage VGH may be applied to the first electrode of the third capacitor C3. Since the second electrode of the third capacitor C3 is connected to the second control node Q, and the second node voltage V_Q has a logic high level, the third capacitor C3 may be discharged.

At a third time point t3, the second clock signal CLK2 may transit from a logic high level to a logic low level.

In this case, the sixth transistor M6 may be turned on in response to the second clock signal CLK2 of the logic low level, and the second clock signal CLK2 of the logic low level may be applied to the first control node QB through the seventh transistor M7 turned on by the second capacitor C2 and the turned on sixth transistor M6. That is, the first node voltage V_QB may be changed to have a logic low level.

The ninth transistor M9 may be turned on in response to the first node voltage V_QB of the logic low level, and the first gate voltage VGH may be applied to the output terminal 104 through the first power terminal 105 and the ninth transistor M9. That is, an output voltage V_OUT may be changed to have a logic high level.

Meanwhile, the thirteenth transistor M13 may be turned on in response to the second clock signal CLK2 of the logic low level, and the first gate voltage VGH applied to the second electrode of the third capacitor C3 through the turned on thirteenth transistor M13 and the twelfth transistor M12 turned on by the second gate voltage VGL may be applied to the second control node Q.

As shown in FIG. 4, when the ninth transistor M9 is turned on, the first gate voltage VGH of the output voltage V_OUT (that is, the light emission control signal) of the first stage ST1 is supplied to the output terminal 104. The first gate voltage VGH supplied to the output terminal 104 may be supplied to the first light emission control line E1 as the light emission control signal.

Thereafter, even though the first control node QB is in a floating state by the changes of the first clock signal CLK1 and the second clock signal CLK2, the first node voltage V_QB may be maintained to a logic low level by the first capacitor C1, and the output voltage V_OUT may be maintained to a logic high level.

At a fourth time point t4, the input voltage VIN may transit from a logic high level to a logic low level.

At a fifth time point t5, the first clock signal CLK1 may transit from a logic high level to a logic low level.

In this case, the first transistor M1 may be turned on in response to the first clock signal CLK1 of the logic low level, and the input voltage VIN of the first logic low level may be applied to the first electrode of the twelfth transistor M12. Since the twelfth transistor M12 is turned on by the second gate voltage VGL, the input voltage VIN of the logic low level may be applied to the second control node Q through the twelfth transistor M12.

The tenth transistor M10 may be turned on in response to the second node voltage V_Q of the logic low level, and the second gate voltage VGL may be applied to the output terminal 104.

Meanwhile, the fourth transistor M4 may be turned on by the input voltage VIN of the logic low level provided through the first transistor M1. In addition, the fifth transistor M5 may be turned on in response to the first clock signal CLK1 of the logic low level, and the second gate voltage VGL (and the first clock signal CLK1) may be applied to the gate electrode of the second transistor M2.

The second transistor M2 may be turned on in response to the second gate voltage VGL, and the first gate voltage VGH may be applied to the first electrode of the third capacitor C3. Since the second electrode of the third capacitor C3 is connected to the second control node Q, the second node voltage V_Q of the logic low level may be applied to the second electrode of the third capacitor C3.

Meanwhile, the eighth transistor M8 may be turned on by the input voltage VIN of a first logic low level, and the first gate voltage VGH may be applied to the first control node QB. That is, the first node voltage V_QB may be changed to have a logic high level.

At a sixth time point t6, the second clock signal CLK2 may transit from a logic high level to a logic low level.

Since the third transistor M3 is turned on by the second node voltage V_Q, the second clock signal CLK2 of the logic low level may be applied to the first electrode of the third capacitor C3. The second node voltage V_Q may be boosted by the third capacitor C3, and the second node voltage V_Q may be changed to have a second logic low level. In addition, the output voltage V_OUT may be changed to have a logic low level in correspondence with the second node voltage V_Q of the second logic low level. Here, the second logic low level may have a voltage level lower than the logic low level, for example, a voltage level (that is, 2VGL) lower than the logic low level by the second gate voltage VGL.

Figure 6A:
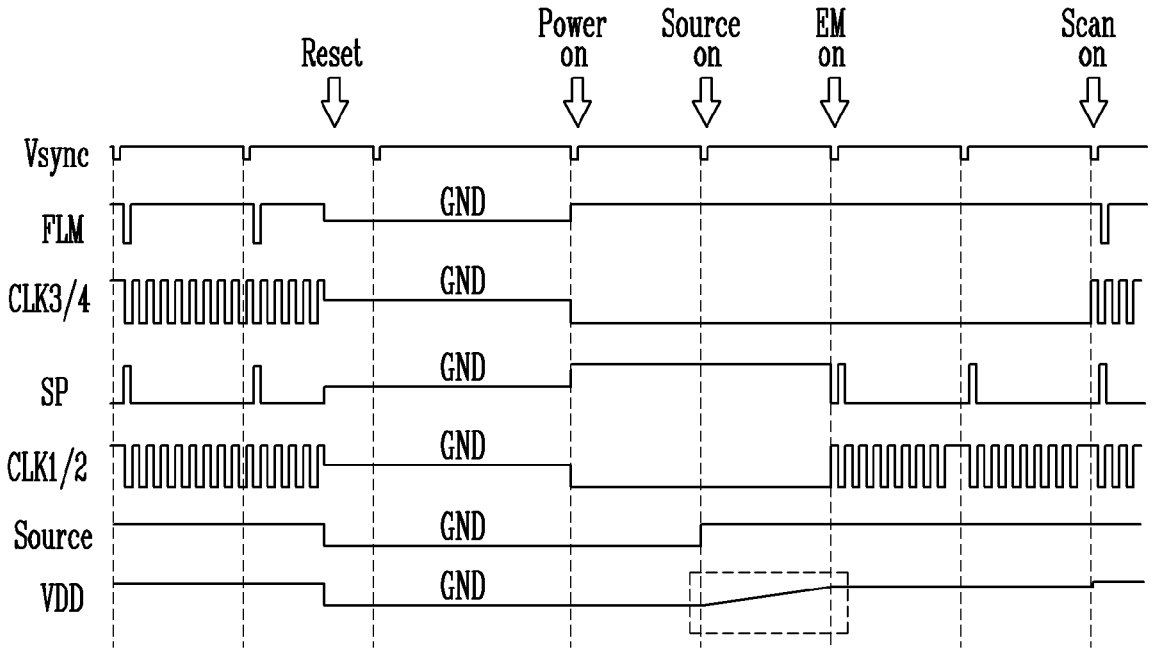
FIGS. 6A and 6B are waveform diagrams illustrating a schematic display on sequence of a display device for describing an effect of a thirteenth transistor of the present invention.
Figure 6B:
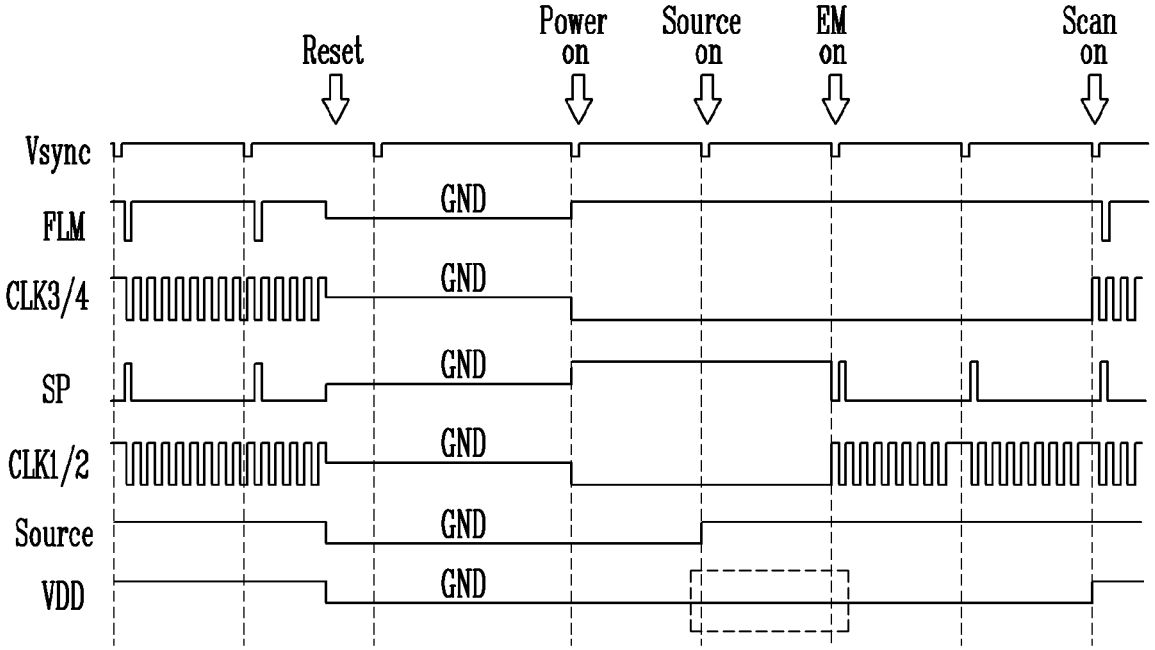
Figure 7:
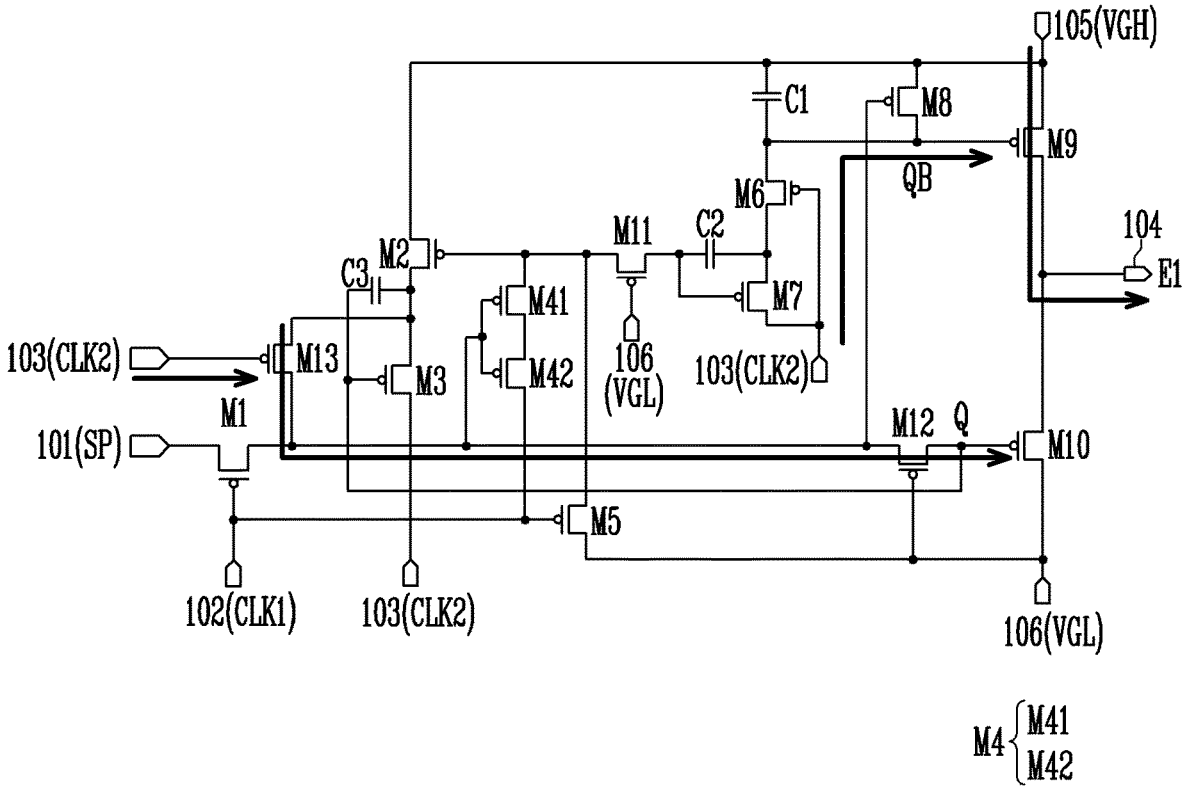
FIG. 7 is a signal flow diagram for describing an operation of the first stage shown in FIG. 4.

FIGS. 6A and 6B are waveform diagrams illustrating a schematic display on sequence of a display device for describing an effect of the thirteenth transistor of the disclosure. FIG. 7 is a signal flow diagram for describing the operation of the first stage shown in FIG. 4. At this time, the waveform diagram of FIG. 6A assumes that the first stage ST1 shown in FIG. 4 does not include the thirteenth transistor M13, and the waveform diagram of FIG. 6B assumes that the first stage ST1 shown in FIG. 4 includes the thirteenth transistor M13.

Referring to FIGS. 1, 4 and 6A, the display device 1 placed in an abnormal state, such as a case of being subjected to shock from the outside, may be forced to be reset for protection of various drivers. In this case, an initial abnormal light emission phenomenon (flashing phenomenon) in which the input voltage VIN of a logic high level is slowly applied to the second control node Q and a screen of the display device 1 flickers may occur.

Specifically, when the display device 1 is forcibly reset, the light emission control driver 30 may instantly change most of the light emission control signals output at a logic low level to a ground level.

When the display device 1 is forcibly reset and then powered on, the start pulse SP of a logic high level and the first and second clock signals CLK1 and CLK2 of a logic low level may be applied to the light emission control driver 30, after a certain time elapses, as shown in FIG. 5, the start pulse SP maintaining a logic high level during four horizontal periods 4H for each one frame 1F and the first and second clock signals CLK1 and CLK2 having a logic low level and a logic high level in two horizontal times 2H may be applied to the light emission control driver 30 (i.e. EM on).

In this case, while the start pulse SP of the logic high level and the first and second clock signals CLK1 and CLK2 of the logic low level are applied to the light emission control driver 30, a source of a black grayscale may be applied to the data driver 40 (i.e. Source on). In addition, a start pulse FLM and the third and fourth clock signals CLK3 and CLK4 for generating the scan signal may be applied to start displaying an image (i.e. Scan on) in one period in which the start pulse SP having the logic high level during the four horizontal periods 4H for each one frame 1F and the first and second clock signals CLK1 and CLK2 having the logic low and the logic high level in the two horizontal times 2H are applied to the light emission control driver 30. (In FIGS. 6A and 6B, although CLK3 and CLk4 are denoted as being supplied, three or more clock signals may be supplied in correspondence with a structure of the scan driver 20.)

When the display device 1 is forcibly reset and then powered on, since the start pulse SP of the logic high level and the first and second clock signals CLK1 and CLK2 of the logic low level are applied to the light emission control driver 30 during a certain period, ideally, the light emission control signal having the first gate voltage VGH (that is, a logic high level) is required to be output.

However, among the plurality of stages ST1 to ST4 (see FIG. 3) of the light emission control driver 30, in a lower stage (for example, ST4), the first gate voltage VGH may be applied to a low buffer gate (second control node Q) of the output terminal 104 relatively slowly, compared to an upper stage (for example, ST1). In this case, since the tenth transistor M10 that is turned off in correspondence with the first gate voltage VGH is not completely turned off, a short-circuit may occur between the second gate voltage VGL and the first gate voltage VGH.

Therefore, since the light emission control signal of which the voltage level is dropped is applied to the third transistor T3 of the pixel circuit PXC of FIG. 2A or the third and fourth transistors T3 and T4 of the pixel circuit PXC' of FIG. 2B, a short-circuit may occur between the first pixel power VDD and the data voltage Vdata through the third transistor T3 of FIG. 2A or the fourth transistor T4 of FIG. 2B that is not completely turned off, and thus the initial abnormal light emission (flashing phenomenon) may occur. In FIG. 6A, a quadrangle box portion indicated by a dotted line indicates that the first pixel power VDD is leaked, and thus the short-circuit occurs between the first pixel power VDD and the data voltage Vdata.

Referring to FIGS. 6B and 7, the first stage ST1 according to an embodiment of the disclosure may additionally arrange a path for applying the first gate voltage VGH through the thirteenth transistor M13 disposed between the second electrode of the second transistor M2 and the second electrode of the first transistor M1, and thus the tenth transistor M10 that is turned off in correspondence with the first gate voltage VGH may be completely turned off. That is, since the second gate voltage VGL is not applied to the output terminal 104, a short-circuit is not generated between the first gate voltage VGH and the second gate voltage VGL, and the light emission control signal of a logic high level may be output.

Therefore, since the light emission control signal of which the voltage level is not dropped is applied to the third transistor T3 of the pixel circuit PXC of FIG. 2A or the third and fourth transistors T3 and T4 of the pixel circuit PXC' of FIG. 2B, the third transistor T3 of FIG. 2A or the fourth transistor T4 of FIG. 2B may be completely turned off. Since a short-circuit is not generated between the first pixel power VDD and the data voltage Vdata, the initial abnormal light emission (flashing phenomenon) may not occur. A quadrangle box portion indicated by a dotted line in FIG. 6B indicates that a leakage of the first pixel power VDD is prevented.

The stage according to the inventive concepts outputs a normal light emission control signal by adding a transistor providing a first gate voltage (gate-off voltage) to a low buffer gate of the output unit, thereby preventing an initial abnormality light emission phenomenon.

The display device according to the inventive concepts outputs a normal light emission control signal by adding a transistor providing a first gate voltage (gate-off voltage) to a low buffer gate of the output unit, thereby preventing an initial abnormality light emission phenomenon.

Although the inventive concepts have been described with reference to the embodiments thereof, it will be understood by those skilled in the art that the inventive concepts may be variously modified and changed without departing from the spirit and scope of the inventive concepts disclosed in the following claims.

What is claimed is:

1. A display device comprising:

a display unit including pixels connected to scan lines, data lines, and light emission control lines;

a scan driver to supply a scan signal to the scan lines;

a data driver to supply a data signal to the data lines;

a light emission control driver including a plurality of stages to supply a light emission control signal to the light emission control lines; and a timing controller to output a scan driving control signal for controlling the scan driver, a data driving control signal for controlling the data driver, and a light emission driving control signal for controlling the light emission control driver;

wherein:

each of the stages comprises:

a node control unit to control a voltage of a first control node and a voltage of a second control node, according to a first input signal supplied to a first input terminal, a second input signal supplied to a second input terminal, and a third input signal supplied to a third input terminal;

a node maintenance unit to maintain the voltage of the first control node to be constant according to the voltage of the second control node; and an output unit to supply a first gate voltage supplied to a first power terminal or a second gate voltage supplied to a second power terminal to an output terminal according to the voltage of the first control node and the voltage of the second control node; and the node control unit comprises a short-circuit preventing transistor connected between the first power terminal and the second control node to prevent a short-circuit between the first power terminal and the second power terminal.

2. The display device according to claim 1, further comprising:

a first transistor connected between the first input terminal and the second control node and including a first electrode connected to the first input terminal; and a second transistor connected between the first power terminal and the third input terminal and including a first electrode connected to the first power terminal, wherein the short-circuit prevention transistor is connected between the first transistor and the second transistor and including a first electrode connected to a second electrode of the second transistor and a second electrode connected to a second electrode of the first transistor.

3. The display device according to claim 2, wherein a gate electrode of the short-circuit prevention transistor is connected to the third input terminal, and the short-circuit prevention transistor is turned on according to the third input signal.

4. The display device according to claim 2, wherein the output unit comprises:

a pull-up transistor including a first electrode connected to the first power terminal, a second electrode connected to the output terminal, and a gate electrode connected to the first control node; and a pull-down transistor including a first electrode connected to the output terminal, a second electrode connected to the second power terminal, and a gate electrode connected to the second control node.

5. The display device according to claim 2, wherein the first gate voltage is set to a gate-off voltage, and the second gate voltage is set to a gate-on voltage.

6. The display device according to claim 2, wherein:

the first input signal is a start pulse or an output signal of a previous stage; and the second input signal and the third input signal are a first clock signal and a second clock signal, respectively.

7. The display device according to claim 6, wherein:

the first clock signal and the second clock signal alternately have a gate-on voltage; and the start pulse or the output signal of the previous stage is supplied to overlap at least one gate-on voltage section of the first clock signal.

8. The display device according to claim 1, wherein a gate electrode of the first transistor is connected to the second input terminal, and the first transistor is turned on according to the second input signal.

9. The display device according to claim 8, wherein the node control unit comprises:

a third transistor including a first electrode connected to the second electrode of the second transistor, a second electrode connected to the third input terminal, and a gate electrode connected to the second control node;

a fourth transistor including a first electrode connected to a gate electrode of the second transistor, a second electrode connected to the second input terminal, and a gate electrode connected to the second electrode of the first transistor;

a fifth transistor including a first electrode connected to the first electrode of the fourth transistor, a second electrode connected to the second power terminal, and a gate electrode connected to the second input terminal;

a first coupling transistor including a first electrode connected to the first electrode of the fifth transistor, a second electrode, and a gate electrode connected to the second power terminal;

a first coupling capacitor including a first electrode connected to the second electrode of the first coupling transistor, and a second electrode;

a sixth transistor including a first electrode connected to the first control node, a second electrode connected to the second electrode of the first coupling capacitor, and a gate electrode connected to the third input terminal; and a seventh transistor including a first electrode connected to the second electrode of the first coupling capacitor, a second electrode connected to the third input terminal, and a gate electrode connected to the first electrode of the first coupling capacitor.

10. The display device according to claim 9, wherein the node control unit further comprises:

a second coupling capacitor including a first electrode connected to the second electrode of the second transistor and a second electrode connected to the gate electrode of the third transistor; and a second coupling transistor connected between the second electrode of the first transistor and the second control node and turned on according to the second gate voltage.

11. The display device according to claim 10, wherein the node maintenance unit comprises:

an eighth transistor including a first electrode connected to the first power terminal, a second electrode connected to the first control node, and a gate electrode connected to the second electrode of the first transistor; and a first capacitor including a first electrode connected to the first power terminal and a second electrode connected to the first control node.

* * * * *